US008677530B2

(12) United States Patent
Calkin

(10) Patent No.: US 8,677,530 B2
(45) Date of Patent: Mar. 25, 2014

(54) RESCUE STRETCHER WITH SECUREMENT STRAPS

(71) Applicant: Skedco, Inc., Tualatin, OR (US)

(72) Inventor: Carston R. Calkin, Tualatin, OR (US)

(73) Assignee: Skedco, Inc., Tualatin, OR (US)

( * ) Notice: Subject to any disclaimer, the term of this patent is extended or adjusted under 35 U.S.C. 154(b) by 0 days.

(21) Appl. No.: 13/933,984

(22) Filed: Jul. 2, 2013

(65) Prior Publication Data

US 2014/0053335 A1 Feb. 27, 2014

Related U.S. Application Data

(63) Continuation-in-part of application No. 29/430,096, filed on Aug. 21, 2012.

(51) Int. Cl.
*A47B 1/00* (2006.01)

(52) U.S. Cl.
USPC ..... 5/628; 5/625; 5/627

(58) Field of Classification Search
USPC ..... 5/625–629
See application file for complete search history.

(56) References Cited

U.S. PATENT DOCUMENTS

| | | | | | |
|---|---|---|---|---|---|
| 1,270,107 | A | * | 6/1918 | Boardman | 5/627 |
| 2,361,789 | A | * | 10/1944 | Nicholas | 5/628 |
| 2,366,082 | A | * | 12/1944 | Baker | 5/628 |
| 2,899,692 | A | | 7/1955 | Finken | |
| 2,788,530 | A | * | 4/1957 | Ferguson | 5/628 |
| 3,046,982 | A | * | 7/1962 | Davis | 128/875 |
| 3,158,875 | A | * | 12/1964 | Fletcher | 5/628 |
| 3,287,895 | A | * | 11/1966 | Hire | 5/627 |
| 3,707,734 | A | * | 1/1973 | Matthews | 5/628 |
| 4,127,120 | A | * | 11/1978 | Applegate | 5/628 |
| 4,151,842 | A | * | 5/1979 | Miller | 602/19 |
| 4,347,635 | A | * | 9/1982 | Eisenhauer | 441/40 |
| 4,601,075 | A | | 7/1986 | Smith | |
| 5,014,374 | A | * | 5/1991 | Williams | 5/628 |
| 5,027,833 | A | | 7/1991 | Calkin | |
| 5,048,134 | A | * | 9/1991 | Dennill et al. | 5/625 |
| 5,211,186 | A | * | 5/1993 | Shoemaker et al. | 5/628 |
| 5,285,797 | A | * | 2/1994 | Zeller | 5/628 |
| 5,729,850 | A | | 3/1998 | Eskeli | |
| D421,413 | S | | 3/2000 | Calkin | |

(Continued)

OTHER PUBLICATIONS

Veasey et al., Confined Space Entry and Emergency Response, 2002, pp. 429-433, The McGraw-Hill Companies, Inc., U.S.

(Continued)

*Primary Examiner* — William Kelleher
*Assistant Examiner* — Eric Kurilla
(74) *Attorney, Agent, or Firm* — Stoel Rives LLP

(57) ABSTRACT

A stretcher including a flexible base panel sized to support a person lying thereon during a rescue or extrication operation. The base panel includes a header end and an opposite footer end, and further includes a head-supporting region and a body-supporting region. The head-supporting region is sized to support the head and shoulders of the person and the body-supporting region is sized to support a human torso. The stretcher further includes a securement strap extending from the head-supporting region along one side of the base panel and crossing over to the body-supporting region at the other side of the base panel. The securement strap extends diagonally across the shoulder and torso of the person to arrest the shoulder and limit sliding movement of the person toward the header end of the panel.

10 Claims, 2 Drawing Sheets

(56) References Cited

U.S. PATENT DOCUMENTS

| | | | | |
|---|---|---|---|---|
| 6,871,368 | B2 * | 3/2005 | Calkin | 5/628 |
| 6,966,087 | B2 * | 11/2005 | Robinette | 5/625 |
| 7,422,220 | B2 * | 9/2008 | Walkingshaw et al. | 280/18 |
| 7,810,820 | B2 | 10/2010 | Wolf et al. | |
| 2004/0088794 | A1 | 5/2004 | Calkin | |
| 2007/0136950 | A1 * | 6/2007 | Zuercher | 5/627 |
| 2010/0005593 | A1 * | 1/2010 | Bowling et al. | 5/627 |
| 2010/0233922 | A1 * | 9/2010 | Cynamon | 441/80 |
| 2012/0102650 | A1 * | 5/2012 | McGlynn | 5/627 |

OTHER PUBLICATIONS

ARC Products, Med-Sled Vertical Lift Rescue, 2009, 2 pgs.

* cited by examiner

RESCUE STRETCHER WITH SECUREMENT STRAPS

RELATED APPLICATION

This application is a continuation-in-part of and claims the benefit under 35 U.S.C. §120 from U.S. patent application Ser. No. 29/430,096, filed Aug. 21, 2012, the entirety of which is incorporated herein by reference.

TECHNICAL FIELD

The field of the disclosure relates generally to rescue stretchers with straps for securing an injured person to the rescue stretcher during emergency extrication and transport.

BACKGROUND

Transporting an incapacitated or injured person to a hospital or other treatment facility is often an essential part of providing proper medical care. An ambulance, helicopter, or other similar vehicle is well-known for such transport. However, in some instances, such as when the injured person is in a forested area, on an embankment, or on a battlefield, transport vehicles may have difficulty accessing the location of the injured person. In such cases, the injured person is typically first transported from the injury site to the ambulance and thereafter taken to the hospital or other treatment facility. Lightweight and easily deployable stretchers, litters, and other similar devices are known for facilitating such casualty movement. To help prevent further injury, these devices generally include restraints or straps to immobilize the injured person during transport.

The present inventor has recognized some disadvantages with such lightweight stretchers. For instance, during use of the stretcher, the straps typically extend transversely across the stretcher and are tightly cinched to restrain the person on the stretcher. One disadvantage of this configuration is that the injured person is primarily restrained via the compressive force of the tightened straps, which may complicate or exacerbate existing injuries. In addition, while transverse straps may help prevent the injured person from rolling off the sides of the rescue stretcher, such straps are not particularly well-suited for preventing the person from sliding toward the top or bottom ends of the stretcher. Preventing this movement is a great concern during air-lift rescue operations or transport on sloped terrains where gravitational forces pull the injured person and may cause sliding off the top or bottom ends of the stretcher.

Accordingly, the present inventor has recognized a need for an improved rescue stretcher with securement straps to arrest movement along the top, bottom, and sides of stretcher while minimizing the compressive forces exerted on the injured person. Additional aspects and advantages will be apparent from the following detailed description of preferred embodiments, which proceeds with reference to the accompanying drawings.

DETAILED DESCRIPTION OF PREFERRED EMBODIMENTS

With reference to the drawings, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 1:
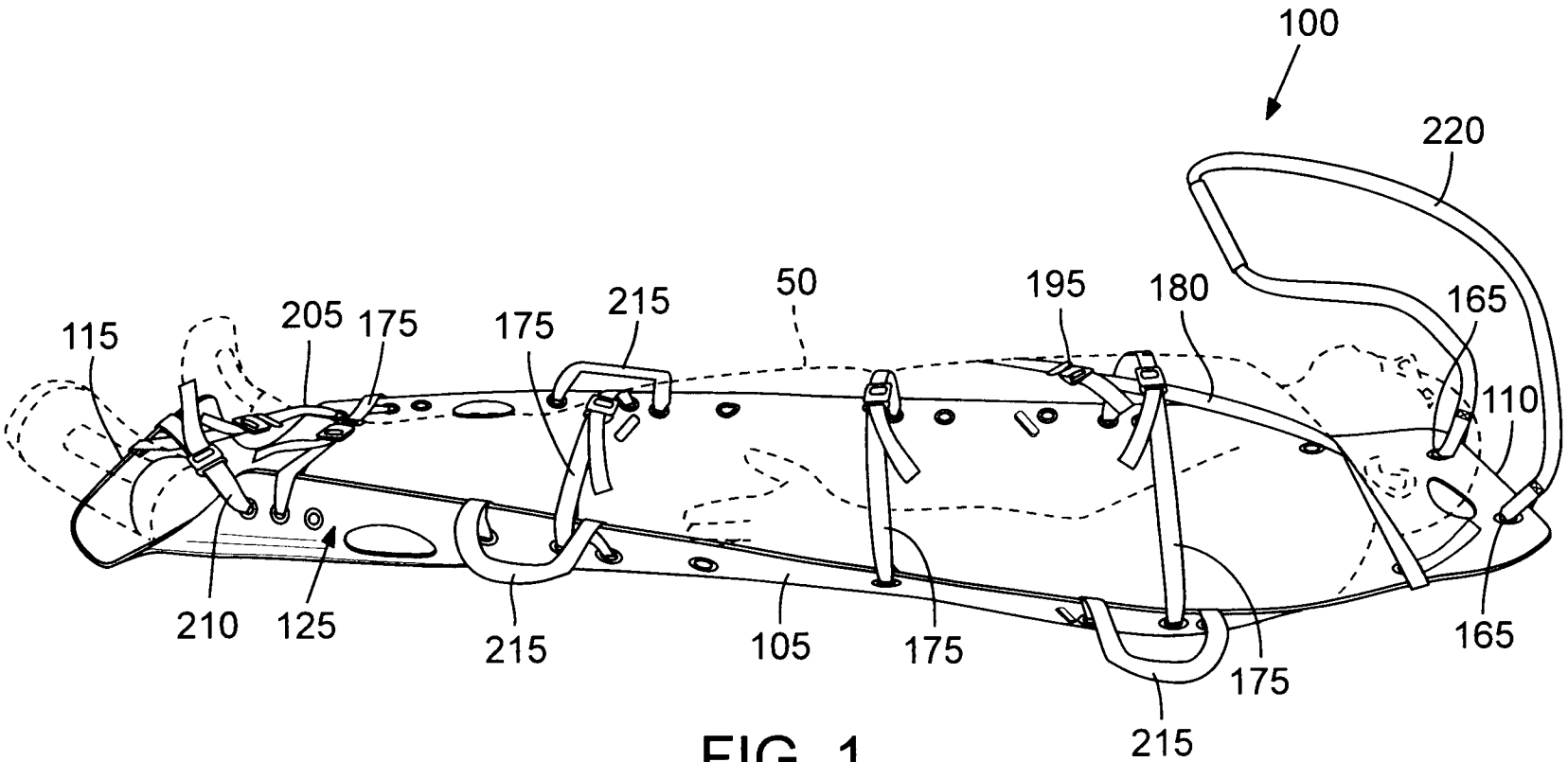
FIG. 1 is a perspective view of a rescue stretcher in a tensioned and operative configuration according to one embodiment.
Figure 2:
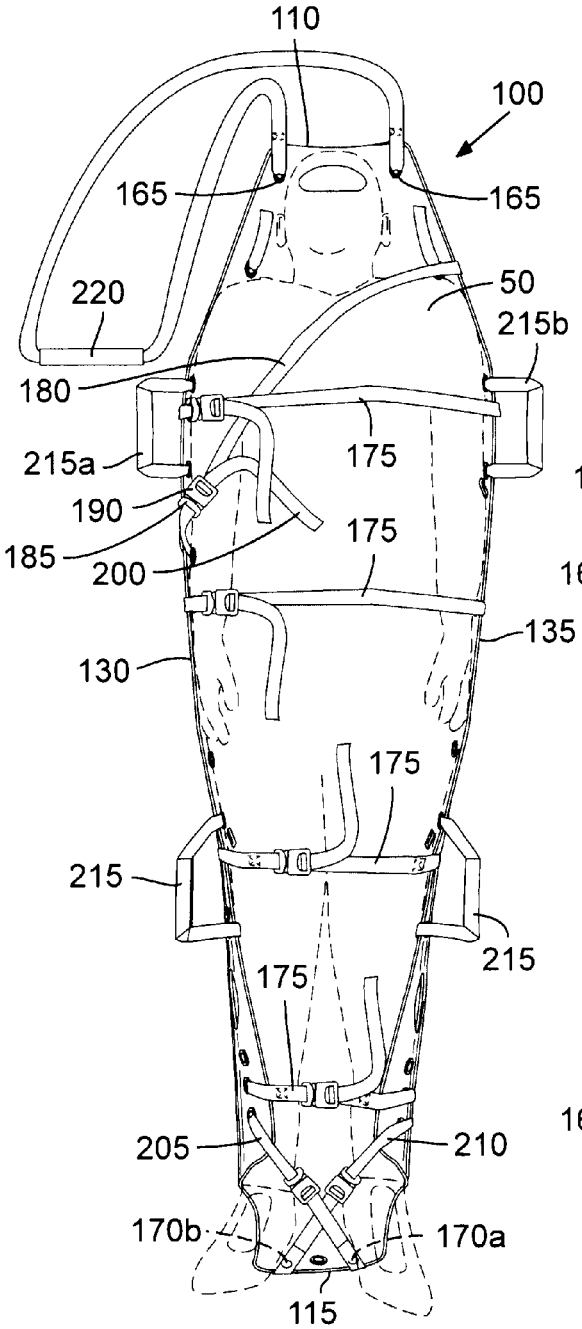
FIG. 2 is a top plan view of the rescue stretcher of FIG. 1.
Figure 3:
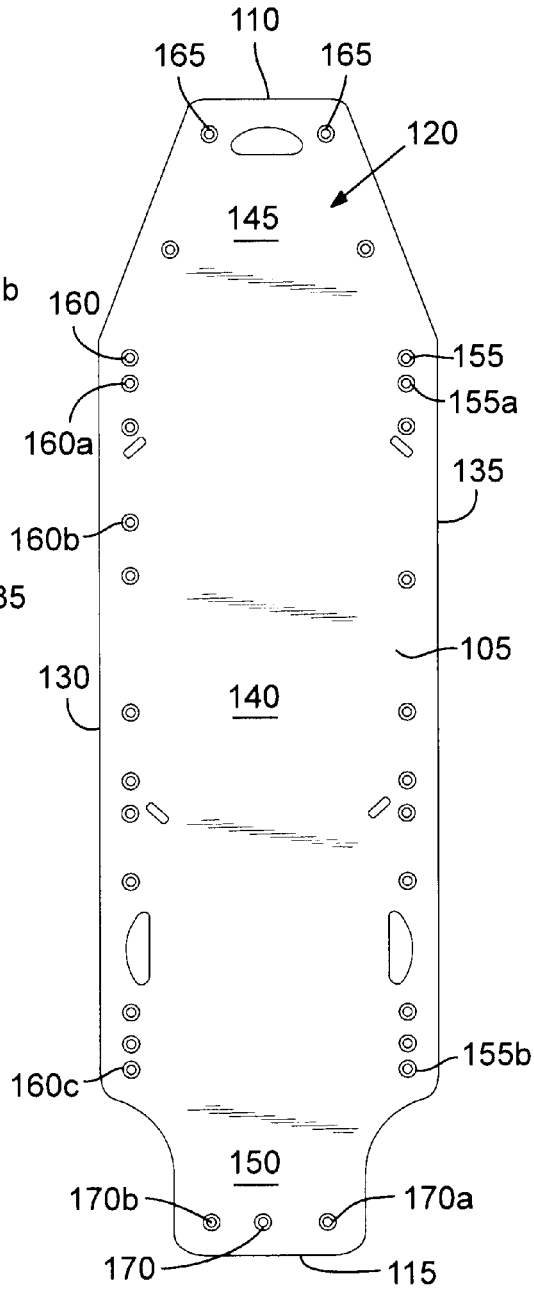
FIG. 3 is a top plan view of the rescue stretcher of FIG. 1 in a flat and relaxed configuration.

FIGS. 1-3 illustrate various detailed views of a rescue stretcher 100 that may be used to support and safely extract an injured person 50 from a hazardous environment. Rescue stretcher 100 includes an elongated, flexible base panel 105 panel having a plurality of eyelets 155, 160 spaced along left and right edges 130, 135, respectively. Base panel 105 further includes a plurality of eyelets 165, 170 spaced along header and footer ends 110, 115, respectively. In addition, rescue stretcher 100 includes securement straps 175, 180, 205, 210 each threaded through some of the eyelets 155, 160, 165, 170 and spaced apart from another in any desired configuration (for example, as shown in FIG. 1).

In one example configuration, a number of straps 175 extend transversely across the base panel 105. When straps 175 are tightened, base panel 105 rolls inwardly to at least partially cradle person 50 and help prevent person 50 from rolling off the base panel 105 (e.g., such as via left and right edges 130, 135). Similarly, straps 205, 210, when tightened, pull a portion of footer end 115 inwardly to support the feet of person 50 and limit movement of the person 50 toward the footer end 115 of rescue stretcher 100. Finally, shoulder strap 180 extends across a shoulder and a chest of the injured person 50 from a head-supporting region 145 to a central body-supporting region 140 of base panel 105. Shoulder strap 180 arrests the shoulder and helps prevent injured person 50 from slipping or moving toward header end 110 of base panel 105.

The following describes further detailed aspects of this and other embodiments of rescue stretcher 100. In the following description of the figures and any example embodiments, reference may be made to using the rescue stretcher disclosed herein to support and transport injured person. It should be understood that any such references merely refer to one prospective use for such a rescue stretcher and should not be considered as limiting. Other uses for such rescue stretcher with the characteristics and features described herein are possible, including uses to transport captured animals/game, or transporting equipment, firewood, ammunition, or other heavy loads (including both military and civilian uses). Still other uses not specifically described herein may be possible.

In addition, the following disclosure may include references to an injured person's body parts and/or particular regions of the body. It should be understood that any such discussion is meant to facilitate description and establish a frame of reference relating to a typical injured person with all limbs and body parts intact. Accordingly, any such references are for convenience only and should not be considered as limiting.

With reference to FIGS. 1-3, rescue stretcher 100 includes an elongated base panel 105 formed of a lightweight and flexible material with strength and durability characteristics suitable for supporting the weight of an injured person 50 during transport. In one embodiment, base panel 105 comprises a single sheet of lightweight plastic material, such as medium-density polyethylene or a synthetic thermoplastic resin, selected for durability, strength, flexibility and resistance to damage (such as from cutting, scarring, denting, breaking, and deforming) to provide a suitable rescue stretcher 100 for carrying injured people.

Base panel 105 includes a header end 110 and a footer end 115 opposite header end 110. Base panel 105 further includes opposite front and back surfaces 120, 125 and opposite left and right peripheral sides 130, 135. To establish a frame of reference, front surface 120 refers to a surface of base panel 105 that receives injured person 50 during use of rescue stretcher 100. Back surface 125 refers to the opposite surface of the base panel 105 that may contact the ground, such as during a dragging operation.

With particular reference to FIG. 3, front surface 120 of base panel 105 is divided into three main regions: a body-supporting region 140, a head-supporting region 145, and a foot-supporting region 150. Head-supporting region 145 is bounded by left and right sides 130, 135 of base panel 105 and is located between body-supporting region 140 and header end 110. Similarly, foot-supporting region 150 is bounded by left and right sides 130, 135 of base panel 105 and is located between body-supporting region 140 and footer end 115. Body-supporting region 140 is bounded by left and right sides 130, 135 and spans between head-supporting region 145 and foot-supporting region 150 on base panel 105.

In general terms, the head-supporting region 145 is sized to support the head, neck, shoulders, and an upper portion of the body transected by a line extending between the axilla (i.e., underarm or armpit) of the injured person 50. Foot-supporting region 150 is sized to support the feet of the injured person 50 and a portion of the lower leg up to about the ankle. Body-supporting region 140 supports the remaining portion of the body, that is, the portion that extends generally from the chest region (e.g., below the axilla) to the ankles.

Overall, base panel 105 may have suitable dimensions for receiving and comfortably supporting injured person 50. For instance, in one example embodiment, base panel 105 may have a length (as measured from header end 110 to footer end 115) ranging from between 72 to 84 inches and a width (as measured from left side 130 to right side 135) ranging from between 18 to 30 inches. In addition, head and foot-supporting regions 145, 150 may each range in length from between 12 to 24 inches, with body-supporting region 140 ranging in length from between 48 to 60 inches to accommodate the injured person 50. Base panel 105 may range in thickness from between 1/16 inches to about 1/4 inches. It should be understood that the particular dimensions described illustrate one example embodiment and that any suitable dimensions may be used. For instance, the length and width dimensions may be smaller rescue stretchers targeted primarily for use with children.

As illustrated in FIGS. 1-3, in some embodiments, base panel 105 may not have a uniform width throughout, but may include one or more tapered sections. For instance, in one embodiment, left and right sides 130, 135 of base panel 105 may taper inwardly toward header end 110 and toward footer end 115. In some embodiments, the left and right sides 130, 135 may uniformly and gradually taper toward header end 110 to define a generally trapezoidal-shaped head-supporting region 145. In such embodiments, base panel 105 is narrower at header end 110 as compared to body-supporting region 140. In such a configuration, rescue stretcher 100 receives and supports the head of injured person 50 without obstructing the sides of the head of injured person 50 when rescue stretcher 100 is in an operative condition (for example, as illustrated in FIG. 2). Preferably, the width of the stretcher at the footer end 115 is such that it becomes an anatomical leg split when the straps (e.g., straps 175, 205, 210) are tightened around the legs.

Similarly, left and right sides 130, 135 may gradually taper or curve inwardly toward foot-supporting region 150. Preferably, the left and right sides 130, 135 curve inwardly toward footer end 115 to help promote rolling of foot-supporting region 150 when the rescue stretcher 100 is in use. Further details relating to the rolling feature of foot-supporting region 150 are described below.

With particular reference to FIG. 3, base panel 105 further includes a plurality of eyelets or apertures 155, 160, 165, 170 that may drilled, cut, punched, or otherwise formed using any suitable techniques. In some embodiments, some or all of eyelets 155, 160, 165, 170 may be reinforced using conventional metal grommets (which may also be referred to as eyelets) to reduce the risk of tearing portions of base panel 105.

Eyelets 155, 160 may each be spaced inwardly between two to four inches from right and left edges 135, 130, respectively. In addition, eyelets 165, 170 may each be spaced inwardly between two to four inches from header and footer ends 110, 115, respectively. In one embodiment, eyelets 155 on right side 135 and eyelets 160 on left side 130 are arranged in a mirrored configuration such that eyelets 155 horizontally align with eyelets 160 to create number of eyelet pairs (for example, eyelet 155*a* and eyelet 160*a* comprise an eyelet pair). Similarly, eyelets 165 in header region 145 and eyelets 170 in footer region 150 may be arranged in a mirrored configuration along left and right sides 130, 135 of base panel 105. In some embodiments, eyelet 160*b* (shown along left side 130 of base panel 105 in FIG. 3) may or may not include a paired eyelet on right side 135 depending on a particular arrangement of shoulder strap 180 as discussed in further detail below.

With particular reference to FIGS. 1 and 2, rescue stretcher 100 further includes a plurality of securement straps 175 stretching transversely across base panel 105 and over person 50 for securing person 50 in rescue stretcher 100 when in use. Each securement strap 175 may be threaded through one of the eyelet pairs (e.g. 155*a*, 160*a*) to secure injured person 50 along various regions of the body, such as the chest, mid-section, thighs, and lower legs of person 50.

In addition, rescue stretcher 100 includes an elongate shoulder strap 180 extending from right side 135 of head-supporting region 145 and crossing over a shoulder and sternum of injured person 50 to attach along left side 130 of body-supporting region 140. Shoulder strap 180 may include mating first and second buckle parts 185, 190 of a two-piece buckle 195 for securing person 50 on rescue stretcher 100. Shoulder strap 180 may also include an adjustment section 200 for snuggly cinching shoulder strap 180 to accommodate people of different size and bulk on rescue stretcher 100, and/or to permit a desired degree of adjustability for tightly securing an injured person 50 to rescue stretcher 100 as may be necessary. In such a crossover arrangement, shoulder strap 180 arrests the shoulder of injured person 50 to inhibit or prevent substantial sliding movement of injured person 50 toward header end 110 during an extraction operation.

With reference to FIGS. 2 and 3, in some embodiments, rescue stretcher 100 may include a pair of foot straps 205, 210 extending from foot-supporting region 150 and connecting to eyelets on body-supporting region 140. In one configuration, foot strap 205 may be threaded through eyelet 170*a* along right side 135 of foot-supporting region 150 and extend across foot-supporting region 150 to eyelet 160*c* on left side 135 of body-supporting region 140. Similarly, foot strap 210 may be threaded through eyelet 170*b* along left side 130 of foot-supporting region 150 and extend across foot-supporting region 150 to eyelet 155*b* on right side 135 of body-supporting region 140. In such embodiments, foot straps 205, 210 are arranged in a crossover pattern over foot-supporting region 150. When tightly cinched, the foot straps 205, 210 urge footer end 150 to roll inwardly toward body-supporting region 140 of base panel 105 to support the feet of the injured person 50 and resist sliding movement of injured person 50 toward footer end 115.

In other embodiments, rescue stretcher 100 may include a second shoulder strap (not shown) stretching across the injured person 50 from the left side 130 of head-supporting region 145 and crossing over shoulder strap 180 to connect to a right side 135 of body-supporting region 140 to provide additional resistance against sliding movement of injured person 50. In addition, it should be understood that although four transverse securement straps 175, one shoulder strap 180, and two foot straps 205, 210 are specifically illustrated and described, rescue stretcher 100 may include a greater or fewer number of the securement straps in other embodiments.

Preferably, straps 175, 180, 205, 210 are each made of a continuous elongate strip of fabric, such as woven nylon webbing, although other materials may also be suitable. In other embodiments, straps 175, 180, 205, 210 may not be continuous and may instead comprise combined segments of material. In addition, various buckle types may be used for two-piece buckle 195, such as a three-way buckle, double bar buckle, swivel bar buckle, or others. In addition, first buckle part 185 and second buckle part 190 may each be constructed from the same or different materials such as metal or plastic.

In some embodiments, rescue stretcher 100 may further include loop handles 215 threaded through one or more eyelets 155, 160 along left and right sides 130, 135 of base panel 105. Loop handles 215 are preferably formed from reinforced webbing similar to straps 175, 180, 205, 210, but may be formed from other suitable material, and are generally sized to accommodate an adult human hand.

Preferably, loop handles 215 are separated into distinct handle pairs (for example, 215*a* and 215*b* comprise one handle pair) located on opposite sides of base panel 105. Each loop handle pair (e.g. 215*a*, 215*b*) is spaced apart from any other loop handle pair to provide adequate spacing to allow for people to carry rescue stretcher 100 during an extraction operation. Some embodiments may include more or fewer loop handles arranged in a different configuration as described herein. For example, one embodiment may include additional loop handles located along header and footer ends 110, 115 to allow rescue personnel to position themselves at the head and/or the foot of person 50 to carry person 50 through narrow doors or other passages.

In some embodiments, a drag strap 220 may threaded through a pair of apertures 165 located along header end 110. The drag strap 220 extends beyond the header end 110 of rescue stretcher 100 and may have a looped handle to provide a grasping point for rescue personnel. In some embodiments, drag strap 220 may be made of reinforced webbing or other suitable material with sufficient tensile strength for carrying out a dragging extraction operation of an adult person 50.

In other embodiments, rescue stretcher 100 may include multiple drag straps for facilitating dragging by more than one rescuer or allowing a single rescuer to pull the person 50 with both hands. For example, instead of a looped drag strap 220, rescue stretcher 100 may include two individual straps without a looped handle, where one strap is laterally spaced apart from the other strap and each is threaded through an individual eyelet (e.g. eyelet 165) on header end 110. Other arrangements not specifically described herein may be possible.

With particular reference to FIGS. 1 and 2, the following description relates to an example operation of the rescue stretcher 100. In one operation, the rescue stretcher 100 is carried to a position where person 50 is located and laid flat on the ground with the back surface 125 contacting the ground. The person 50 is positioned on front surface 120 of the rescue stretcher 100, with the head, neck, and shoulders resting on head-supporting region 145, the feet supported on foot-supporting region 150, and the remainder of the body supported by body-supporting region 140. Once properly positioned, person 50 is restrained on rescue stretcher 100 using securement straps 175, 180, 205, 210. Straps 175 are stretched transversely across person 50, secured with two-piece buckle 195, and cinched as necessary. When straps 175 are cinched, left and right edges 130, 135 of base panel 105 may roll inwardly toward one another so that base panel 105 cradles and better supports person 50. Thereafter, shoulder strap 180 may be stretched across the shoulder and sternum of person 50 from head-supporting region 145 along one of the left or right sides 130, 135 and connected via buckle 195 at body-supporting region 140 along the other of the left or right sides 130, 135. When shoulder strap 180 is cinched, base panel 105 may further roll inwardly near the shoulders of person 50 to support person 50. Finally, foot straps 210, 215 are stretched across foot-supporting region 150 in a crossover pattern to secure the feet. When straps 210, 215 are cinched, foot-supporting region 150 rolls upward and inwardly toward person 50 to provide a supporting surface for the feet.

In the described configuration, transverse straps 175 support person 50 and primarily resist movement toward the left and right sides 130, 135 of base panel 105. In addition, shoulder strap 180 arrests the shoulder and resists sliding movement toward header end 110, while foot straps 210, 215 support the feet and resist movement toward the footer end 115. Once the person 50 is secured on rescue stretcher 100, rescue personnel can carry person 50 using the plurality of loop handles 215 or pull person 50 using drag strap 220 as necessary.

In some operations, person 50 may be extracted using a combination of dragging and/or carrying techniques. For example, person 50 may be carried over some obstacles that are harder to maneuver around and dragged through narrow areas or in situations where only one rescuer is available. In yet other operations, the drag strap 220 and/or the plurality of loop handles 215 may be attached to a winch or other similar device to drag or hoist the person 50 to safety, such as by helicopter. In still other operations, a harness or other restraint (not shown) may be threaded through some or all of the apertures on the rescue stretcher to support air-lifting rescues. Other operations not specifically mentioned herein may also be possible.

It will be obvious to those having skill in the art that many changes may be made to the details of the above-described embodiments without departing from the underlying principles of the invention. The scope of the present invention should, therefore, be determined only by the following claims.

The invention claimed is:

1. A stretcher comprising:

an elongate, flexible panel sized to completely underlay a person laying thereon, the panel including a header end and an opposite footer end, a left side and an opposite right side, the panel further including a body-supporting region and a head-supporting region, wherein the body-supporting region spans between the header and footer ends of the panel and is sized to support the person, wherein the head-supporting region spans between the header end of the panel and the body-supporting region and is sized to support a shoulder and a head of the person, and wherein the body-supporting region is wider than a torso of the person and a substantial portion of the head-supporting region;

a first securement strap extending from one of the left or right sides of the panel and across to the other of the left or right sides of the panel to secure the person against the panel when the stretcher is in operative use, a second securement strap having a first segment extending from the head-supporting region along one of the left or right sides of the panel and a second segment extending from the body-supporting region along the other of the left or right sides of the panel, wherein the second securement strap extends diagonally across the panel from the head-supporting region and beyond the first securement strap to attach to the body-supporting region of the panel at a different location than the first securement strap such that, when the stretcher is in use, the second securement strap extends across the shoulder and the torso of the person to arrest the shoulder and limit sliding movement of the person toward the header end of the panel.

2. The stretcher of claim 1, further comprising:

a margin extending around a periphery of the panel and inwardly from the header and footer ends and from the left and right sides of the panel; and a plurality of openings formed along the margin and including a first opening at the head-supporting region along one of the left or right sides of panel and a second opening at the body-supporting region along the other of the left or right sides of the panel, wherein the first segment of the second securement strap is threaded through the first opening at the head-supporting region and the second segment of the second securement strap is threaded through the second opening at the body-supporting region of the panel.

3. The stretcher of claim 2, wherein the second securement strap further includes a two-piece buckle having mating first and second buckle parts, and wherein the first buckle part extends from the first segment of the second securement strap and the second buckle part extends from the second segment of the second securement strap.

4. The stretcher of claim 1, further comprising:

a foot-supporting region spanning from the footer end of the panel to the body-supporting region and sized to support feet of the person; and a first and second foot strap, wherein the first foot strap extends from one of the left or right sides of the panel and the second foot strap extends from the other of the left or right sides of the panel, and wherein each of the first and second foot straps extends over the foot-supporting region and is secured along the footer end of the panel such that the first and second foot straps urge the footer end to roll upwardly and inwardly toward the person to support the feet and limit sliding movement of the person toward the footer end of the panel.

5. The stretcher of claim 4, further comprising:

a first and second opening formed along the footer end of the panel and laterally spaced apart from each other, wherein the first foot strap is threaded through the first opening and the second foot strap is threaded through the second opening, the first and second foot straps extending over the foot-supporting region in a crossover pattern.

6. The stretcher of claim 1, further comprising:

a margin extending around a periphery of the panel and inwardly from the header and footer ends and the left and right sides of the panel;

a first opening formed along the margin on the left side of the panel and a second opening formed along the margin on the right side of the panel, the first and second openings laterally spaced apart and arranged collinearly, wherein the first securement strap is threaded through the first and second openings, the first securement strap spanning transversely across the panel to secure the person against the panel when the stretcher is in operative use.

7. The stretcher of claim 6, further comprising:

a third opening formed along the margin on the left side of the panel and a fourth opening formed along the margin on the right side of the panel, the third and fourth openings laterally spaced apart and arranged collinearly; and a third securement strap threaded through the third and fourth openings, the third securement strap spanning transversely across the panel to secure the person against the panel, wherein, when the stretcher is in operative use, each of the first securement strap, second securement strap, and the third securement strap urge the left and right sides of the panel to roll inwardly toward the person.

8. The stretcher of claim 1, wherein the panel is narrower at the header end than at the body-supporting region, and wherein the left and right sides of the panel taper outwardly from the header end of the panel toward the body-supporting region of the panel.

9. The stretcher of claim 8, wherein the panel is narrower at the footer end than at the body-supporting region, and wherein the left and right sides of the panel taper outwardly from the footer end of the panel toward the body-supporting region of the panel.

10. The stretcher of claim 9, wherein the width of the panel at the body-supporting region is larger than the width of the panel at each of the head-supporting region and the foot-supporting region.

* * * * *

UNITED STATES PATENT AND TRADEMARK OFFICE

CERTIFICATE OF CORRECTION

PATENT NO. : 8,677,530 B2
APPLICATION NO. : 13/933984
DATED : March 25, 2014
INVENTOR(S) : Carston R. Calkin It is certified that error appears in the above-identified patent and that said Letters Patent is hereby corrected as shown below:

In the Claims

In column 2, lines 26-27, please replace "panel 105 panel having" with --panel 105 having--.

In column 5, line 62, please replace "drag strap 220 may threaded" with --drag strap 220 may be threaded--.

In column 6, line 37, please replace "foot straps 210, 215" with --foot straps 205, 210--.

In column 6, line 39, please replace "straps 210, 215" with --foot straps 205, 210--.

In column 6, line 40, please replace "upward" with --upwardly--.

In column 6, line 46, please replace "foot straps 210, 215" with --foot straps 205, 210--.

Signed and Sealed this
Twenty-first Day of April, 2015

Michelle K. Lee

Michelle K. Lee
*Director of the United States Patent and Trademark Office*